United States Patent [19]

Maegdefessel

[11] Patent Number: 4,571,158

[45] Date of Patent: Feb. 18, 1986

[54] GETTER SORPTION PUMP WITH HEAT ACCUMULATOR FOR HIGH-VACUUM AND GAS DISCHARGE SYSTEMS

[75] Inventor: Heinz Maegdefessel, Haslach, Fed. Rep. of Germany

[73] Assignee: Siemens Aktiengesellschaft, Berlin & Munich, Fed. Rep. of Germany

[21] Appl. No.: 644,353

[22] Filed: Aug. 27, 1984

[30] Foreign Application Priority Data

Sep. 9, 1983 [DE] Fed. Rep. of Germany ..... 3332606

[51] Int. Cl.[4] ..... F04B 37/02

[52] U.S. Cl. ..... 417/51; 313/547; 313/554

[58] Field of Search ..... 417/48, 51; 313/547, 313/549, 554, 555, 558

[56] References Cited

U.S. PATENT DOCUMENTS

| | | | |
|---|---|---|---|
| 2,130,190 | 9/1938 | Lederer | 313/554 |
| 2,890,319 | 6/1959 | Watrous, Jr. | 417/48 X |
| 2,899,257 | 8/1959 | Lederer | 417/48 X |
| 3,081,413 | 3/1963 | Cummings | 313/558 X |
| 3,167,678 | 1/1965 | Griessel | 417/51 X |
| 3,381,805 | 5/1968 | Della Porta et al. | 417/48 |
| 3,390,758 | 7/1968 | Reash et al. | 417/48 |
| 3,662,522 | 5/1972 | Della Porta et al. | 417/51 X |
| 3,780,501 | 12/1973 | Porta et al. | 417/51 X |
| 4,515,528 | 5/1985 | Young | 417/51 |

FOREIGN PATENT DOCUMENTS

| | | | |
|---|---|---|---|
| 121210 | 10/1978 | Japan | 417/51 |
| 131511 | 11/1978 | Japan | 417/48 |

*Primary Examiner*—William L. Freeh
*Assistant Examiner*—Paul F. Neils
*Attorney, Agent, or Firm*—Hill, Van Santen, Steadman & Simpson

[57] ABSTRACT

A getter sorption pump has at least one getter member of non-evaporation getter material and a corresponding heating element. With this getter pump, a high pump rate is achieved by means of an extremely large surface in the smallest possible space. For this purpose, the heating element is disposed in an insulating tube and a plurality of individual getter members are attached to the insulator tube at a spacing from one another. The getter pump is employed in high-vacuum and gas discharge systems.

8 Claims, 3 Drawing Figures

GETTER SORPTION PUMP WITH HEAT ACCUMULATOR FOR HIGH-VACUUM AND GAS DISCHARGE SYSTEMS

BACKGROUND OF THE INVENTION

The invention relates to a getter sorption pump for high-vacuum and gas discharge systems comprising at least one getter member of non-evaporating getter material and a corresponding heating element.

In order to achieve a high pump power, a plurality of individual getters had to be previously interconnected, whereby the efficiency increasingly deteriorated with respect to the heating capacity, the problem of heat dissipation intensified, and the space requirement for the accommodation of the individual getters increased, which caused problems. Heating capacity had to be constantly supplied in order to stabilize the pump power over a longer time.

Since the traditional getter substances only develop their optimum pump capabilities for various gases at specific temperatures (selective pump properties), the working temperature either had to be varied or the individual getters had to be held at different temperatures with at least two heating elements.

These necessary techniques were usually disregarded in practice so that the optimum getter properties of the non-evaporating getters remained unexploited. Even previously disclosed getter pumps which comprise a larger, compact getter member instead of many individual getters exhibit the most significant of these disadvantages.

SUMMARY OF THE INVENTION

An object of the invention is to increase the specific performance of getter pumps given simultaneous reduction of the necessary heating capacity and to stabilize them with the assistance of a heat accumulator having extremely high heat storage capacity. It is also an object to achieve a high pump rate by means of an extremely large surface in the smallest possible space.

This object is achieved by providing the heating element within an interior of the insulating tube and externally attaching a plurality of individual getter members to the insulating tube and spaced from one another.

The pump rate of a getter member increases with its surface, and with its porosity as well; but capacity, on the other hand, increases with its mass. Together, both factors define the time-wise stability via the quantity of gas absorbed. This stability is also influenced by the working temperature, which is dependent on the type of gas.

The reduction of the necessary heating capacity in comparison to the employment of many individual getters results from the more efficient use of the heating capacity from the heating element, for example a heating coil (lower radiation losses).

The heat accumulation is achieved by means of the ceramic compound integrated into the structure. The possibilities are extraordinarily flexible and can be easily optimized.

A further advantage of the energy-saving heat accumulation is that a heat-conditioned, good pump effect is maintained over a longer time after the heating voltage has been shut off. Such a shut-off is, for example, absolutely necessary in nuclear accelerator systems in order to avoid disruptions due to foreign fields.

The slow cooling of the getter member also has an advantageous effect since the temperature-dependent, selective optimum pump ranges are very slowly crossed, and thus all important absorption maximums dependent on the type of gas are covered.

The invention shall be explained in greater detail with reference to exemplary embodiments. Parts that do not necessarily contribute to an understanding of the invention are unreferenced or have been omitted from the drawing. Mutually corresponding parts in the figures have been provided with the same reference characters.

DESCRIPTION OF THE PREFERRED EMBODIMENTS

Figure 1:
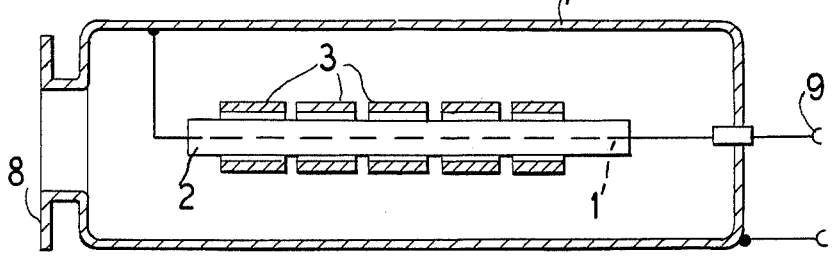
FIG. 1 is a cross-sectional view of a getter sorption pump according to the invention.

The getter sorption pump shown in FIG. 1 is comprised of the heating element 1 which is disposed in an insulating tube 2 preferably consisting of ceramic. The plurality of individual ring-shaped getter members 3 surround and are attached at a spacing from one another on the insulating tube 2. This arrangement is surrounded by a pump vessel 7 which can be connected to the high-vacuum system with a pump flange 8. The heater leads 9 are conducted through the pump vessel 7.

FIG. 2 again shows the insulating tube 2 which is equipped with the heating element 1. It preferably consists of ceramic and serves as a heat accumulator. In this exemplary embodiment, the individual getter members 3 are applied to metal wafers 5 of molybdenum or tungsten. The metal wafers 5 are provided with spacing beads 6. The metal wafers 5 can also be designed as pipe socket parts. Both a good thermally conductive connection to the insulating tube 2 as well as the desired spacing of the individual metal wafers thus result.

Figure 3:
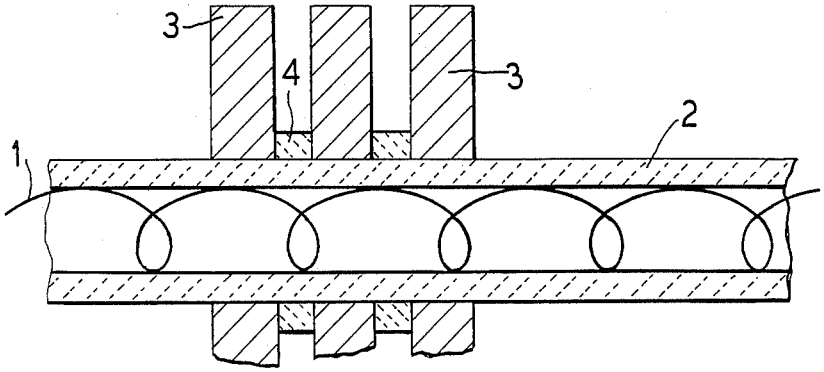

FIG. 3 shows a getter sorption pump wherein the individual getter members 3 applied to the insulating tube 2 of ceramic in which the heating element 1 is provided are spaced from one another by means of metal or ceramic rings 4.

The FIG. 2 and FIG. 3 structures will now be discussed in greater detail. The metal discs 5 illustrated in FIG. 2 consist of molybdenum or tungsten sheet metal. The getter members 3 are sintered onto the metal discs and consist, for example, of mixtures of zirconium carbon (graphite) or zirconium graphite with added ammonium salts (e.g. ammonium carbonate). The getter members 3 can have a variety of shapes. For example, they can be circular or square. Preferably, the discs 5 can have a flange ring-type design like a pipe socket part.

Figure 2:
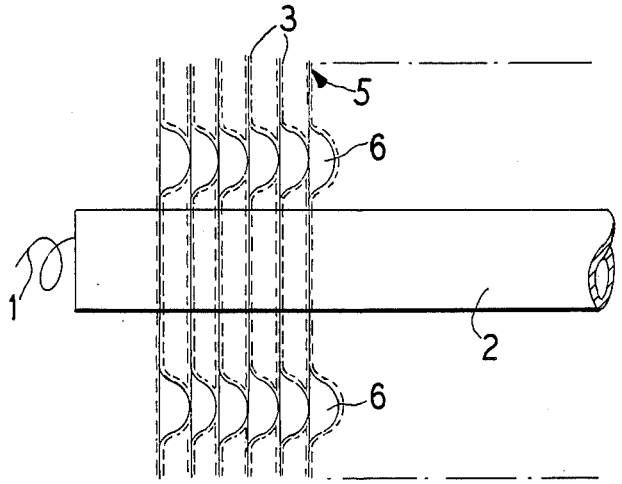
FIGS. 2 and 3 are further exemplary embodiments of the getter sorption pump according to the invention.

The metal discs 5 surround the insulating pipe 2 in FIGS. 2 and 3. The arrangement in both embodiments is rotationally symmetrical. The heating elements in all Figures are mounted outside the insulating pipe with straps or clips. Gaps are required between the getter members. This is achieved either through spacing beads (FIG. 2) or by spacing rings 4 (FIG. 3). The metal discs 5 in FIG. 2 illustrated in lateral view, have recesses (beads 6), with a strip-shaped extension, and are provided with the individual getter members 3.

In all of the above embodiments, the individual getter members 3 consists or are comprised of zirconium, titanium, thorium, tantalum, platinum, niobium, cerium, palladium, and mixtures or alloys thereof.

Although various minor changes and modifications might be proposed by those skilled in the art, it will be understood that I wish to include within the claims of the patent warranted hereon all such changes and modifications as reasonably come within my contribution to the art.

I claim as my invention:

1. In a getter sorption pump for high-vacuum and gas discharge systems having at least one getter member formed of a non-evaporating getter material, and a corresponding heating element, the improvement comprising:

said heating element being disposed within an interior of a heat accumulating insulating tube comprising ceramic; and a plurality of individual getter members each extending radially outwardly of, completely surrounding, and being externally attached to said insulating tube and spaced from one another.

2. A getter sorption pump according to claim 1 wherein said individual getter members are comprised of an element selected from the group consisting of zirconium, titanium, thorium, tantalum, platinum, niobium, cerium, palladium, and mixtures or alloys thereof.

3. A getter sorption pump according to claim 1 wherein said individual getter members are attached to metal wafers which are provided with spacing beads.

4. A getter sorption pump according to claim 3 wherein said metal wafers comprise an element selected from the group consisting of molybdenum or tungsten.

5. A getter sorption pump according to claim 1 wherein said individual getter members are spaced from one another by rings.

6. A getter sorption pump according to claim 5 wherein the rings are metal.

7. A getter sorption pump according to claim 5 wherein the rings are ceramic.

8. A getter assembly for use in a getter sorption pump for high-vacuum and gas discharge systems, comprising:

a heat accumulating insulating tube comprising ceramic;

a heating element positioned within an interior of the tube; and a plurality of individual getter members formed of a non-evaporating getter material and wherein each getter member extends radially outwardly from, completely surrounds, and is externally attached to the tube, and the getter members being spaced from one another along a longitudinal axis of the tube.

* * * * *